US006327864B1

(12) United States Patent
Crowe

(10) Patent No.: US 6,327,864 B1
(45) Date of Patent: Dec. 11, 2001

(54) KIT FOR FACILITATING THE FORMATION OF A FROZEN SURFACE AND METHOD OF FORMING A FROZEN SURFACE USING THE KIT

(76) Inventor: Daniel T. Crowe, 3401 W. Devon, Chicago, IL (US) 60645

( * ) Notice: Subject to any disclaimer, the term of this patent is extended or adjusted under 35 U.S.C. 154(b) by 0 days.

(21) Appl. No.: 09/335,400

(22) Filed: Jun. 17, 1999

(51) Int. Cl.[7] ..... F25C 3/02
(52) U.S. Cl. ..... 62/66; 62/235; 472/92
(58) Field of Search ..... 62/66, 235; 4/506; 472/92; 220/495.08, 495.11

(56) References Cited

U.S. PATENT DOCUMENTS 2,996,896 * 8/1961 Johnson ..... 62/235
3,130,853 * 4/1964 Colthurst et al. ..... 220/495.08
3,667,381 * 6/1972 Bottas et al. ..... 220/495.11
3,808,831 * 5/1974 Landry ..... 62/235
3,933,002 * 1/1976 Vickery ..... 62/235
3,983,713 * 10/1976 MacCracken ..... 62/235
4,135,634 * 1/1979 Frye ..... 62/235
5,134,857 * 8/1992 Burley ..... 62/235
5,150,809 * 9/1992 Leigh ..... 220/495.08
5,669,227 * 9/1997 Morris ..... 62/235

* cited by examiner

*Primary Examiner*—William E. Tapolcai
(74) *Attorney, Agent, or Firm*—Wood, Phillips, VanSanten, Clark & Mortimer

(57) ABSTRACT

A kit having: a border assembly with a plurality of elongate elements that are capable of being placed against a subjacent surface to define a border around a predetermined area within which a frozen surface is to be formed; and a flexible liner that is selectively reconfigurable between a) a collapsed state and b) an operative state. The elongate elements each have an inside surface, a top edge, and an outside surface. The flexible liner has a shape and size preselected to cover a subjacent surface in the predetermined area and to be placed against the elongate elements in a predetermined manner so as to define a receptacle for a liquid that can be cooled to form a frozen surface over the predetermined area.

23 Claims, 4 Drawing Sheets

KIT FOR FACILITATING THE FORMATION OF A FROZEN SURFACE AND METHOD OF FORMING A FROZEN SURFACE USING THE KIT

BACKGROUND OF THE INVENTION

1. Field of the Invention

This invention relates to frozen surfaces, as used for skating and, more particularly, to a kit which facilitates the formation of a frozen surface.

2. Background Art

Ice skating remains a popular activity. In spite of this, there exist a fairly limited number of public facilities which are available for year round or seasonal skating. These facilities typically have indoor and/or outdoor rinks, with the indoor rinks being equipped with systems for forming and maintaining ice at virtually any temperature. These facilities have limited capacity and are commonly not only difficult to access, but expensive to rent.

To cater to a larger skating audience, it is known to prepare frozen skating surfaces in public parks. One method of doing this is to accumulate fallen snow into a border and then to flood the region within the border directly over grass or dirt.

The above method has a number of drawbacks. First of all, there must be an accumulation of snow sufficient to form the border before the frozen surface can be formed. Once the snow has accumulated to a sufficient height, it is typically relocated using relatively heavy plows. Movement of the snow through the plows may result in damage to the underlying grass or other surface.

A further problem, which has been aggravated by recent environmental conditions, is that this type of system may require a significant amount of ongoing maintenance, particularly in the event that the ambient temperature elevates to above freezing for extended periods. It is not uncommon in the prime winter months, throughout the Midwest where temperatures are generally cold, for temperatures to range between subzero and 50–60° F. within a relatively short time period. With the elevated temperatures, the waterfor the frozen surface may not only melt but migrate into the ground. Similarly, the snow border may diminish. The border may have to be constructed and the water replenished periodically, which may be too inconvenient and expensive to be practical in most venues.

The same problems are contended with in attempting to form a frozen surface for skating on private property. Additionally, private home owners contend with the problem of leakage of unrestrained water into buildings or against other objects on their premises.

SUMMARY OF THE INVENTION

In one form, the invention is directed to a kit having: a border assembly with a plurality of elongate elements that are capable of being placed against a subjacent surface to define a border around a predetermined area within which a frozen surface is to be formed; and a flexible liner that is selectively reconfigurable between a) a collapsed state and b) an operative state. The elongate elements each have an inside surface, a top edge, and an outside surface. The flexible liner has a shape and size preselected to cover a subjacent surface in the predetermined area and to be placed against the elongate elements in a predetermined manner so as to define a receptacle for a liquid that can be cooled to form a frozen surface over the predetermined area.

The elongate elements have spaced ends and may be alignable end-to-end to extend continuously around the predetermined area.

The elongate elements may be made from wood.

In one form, the elongate elements have a nominal thickness on the order of 2 inches and a nominal width of from 4–12 inches.

In one form, the flexible liner has a corner preformed thereon to nest at a juncture of two of the elongate elements that are situated relative to each other to define a corner.

The corner of the flexible liner may be formed by adhering one part of the flexible liner to another part of the flexible liner.

The kit may further include a resilient bumper that has a receptacle for the top edge of one of the elongate elements with the resilient bumper fit to the one elongate element to prevent direct contact between a user and the top edge of the one elongate element to which the resilient bumper is fit.

The flexible liner may be a non-UVI plastic.

The liner may be fiber-reinforced plastic.

In one form, the liner has four corners preformed thereon to nest at four inside corners defined by the elongate elements with the predetermined area being one of square and rectangular in shape.

In one form, with the flexible liner placed against the elongate elements in the predetermined manner, the liner defines a receptacle for liquid to be frozen that opens upwardly and extends upwardly from a subjacent surface at least one inch over the entire predetermined area.

The flexible liner may have fold lines preformed therein to facilitate folding in a predetermined manner against the elongate elements.

The kit may further include a bumper that can be press fit over the top edge of one of the elongate elements to captively hold the flexible liner against the one of the elongate elements.

The kit may further include a plurality of brackets through which the ends of adjacent elongate elements can be joined, each to the other.

The invention is also directed to a method of forming a frozen surface including the steps of: providing a plurality of elongate elements each having spaced ends, an inside surface, a top edge, and an outside surface; placing the elongate elements end-to-end to define a border assembly around a predetermined area within which a frozen surface is to be formed; providing a flexible liner; placing the flexible liner on the subjacent surface within the predetermined area; directing the flexible liner from the subjacent surface upwardly against the inside surface of the elongate elements; extending the flexible liner over the top edges of the elongate elements and downwardly against the outside surfaces of the elongate elements; placing a liquid within the predetermined area over the liner; and freezing the liquid to define a frozen surface.

The method may further include the steps of connecting the ends of adjacent elongate elements, each to the other, before directing the flexible liner against the inside surface of the elongate elements.

The method may further include the step of preforming a corner on the flexible liner by adhering one part of the flexible line to another part of the flexible liner before placing the flexible liner on the subjacent surface.

The method may further include the step of providing at least one resilient bumper with a receptacle and directing the at least one resilient bumper downwardly over the top edge of one of the elongate elements so that the top edge of one of the elongate elements moves into the receptacle, so that the at least one resilient bumper prevents direct contact between a user and the top edge of the one of the elongate elements, and so that the flexible liner is captively maintained by the at least one bumper against the one elongate element.

DETAILED DESCRIPTION OF THE DRAWINGS

Figure 1:
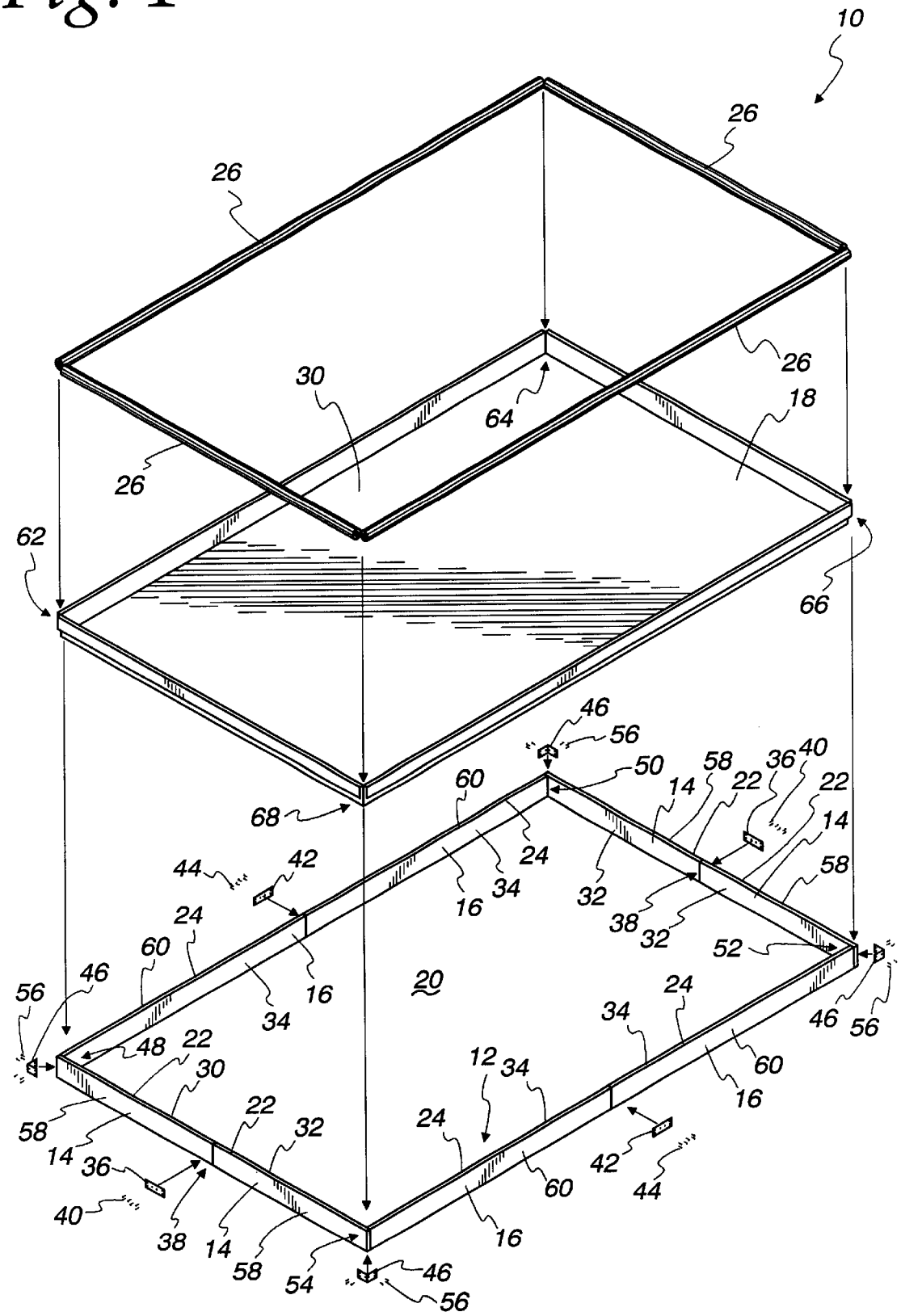
FIG. 1 is an exploded, perspective view of a kit, according to the present invention, used to form a frozen surface and including a flexible liner, a border assembly, brackets for holding elongate elements on the border assembly together, and resilient bumpers.

In FIGS. 1, 2, and 4–10, a kit forfacilitating the formation of a frozen surface, according to the present invention, is shown at 10. The kit 10 consists of a border assembly 12 made up of a plurality of elongate elements 14, 16 that are aligned end-to-end to extend continuously around a predetermined area, which in this case is shown to be a rectangle. Exemplary, anticipated dimensions are 15'×20'; 20'×30'; and 26'×50'. Other sizes and shapes for the predetermined area are contemplated, i.e. square, round, etc.

The kit 10 includes a flexible liner 18 that has a shape and size preselected to cover a subjacent surface 20 within the predetermined area and to be placed against the elongate elements 14, 16 in a predetermined manner so as to define an upwardly opening receptacle for a liquid that can be cooled to form a frozen surface over the predetermined area. As explained in greater detail below, the flexible liner 18 extends from the subjacent surface upwardly and around top edges 22, 24 of the elongate elements 14, 16.

The kit further includes resilient bumpers 26 each having a receptacle 28 to receive the top edges 22, 24 of the elongate elements 14, 16. The resilient bumpers 26 fit on the elongate elements 14, 16 so as to captively maintain the flexible liner 18 against the elongate elements 14, 16 and prevent direct contact between a user and the top edges 22, 24 of the elongate elements 14, 16.

With the kit 10 thus assembled, water or other liquid can be used to cover the exposed, upwardly facing surface 30 of the flexible liner 18 to a height sufficient to form a frozen surface suitable for skating within the border assembly 12. Preferably, the liquid has a height of at least 1 inch over the entire predetermined area.

The makeup and assembly of the kit 10 will now be described in greater detail. The elongate elements 14, 16 may be made from standard stock lumber which may or may not be weather treated. Of course, other material are contemplated for he elongate elements, i.e. recycled plastic, etc. The lumber may have a nominal thickness T on the order of 2" with a height H varying preferably between 4" and 12". The preferred nominal height H for the lumber is 10". The wood is pre-cut for convenience of installation. In this case, four 10' lengths are used for the elongate elements 16 to form the longer sides of the border assembly 12, with four 7½' lengths used for the elongate elements 14 to produce the shorter sides. This produces a predetermined area of approximately 15' by 20' within the inside surfaces 32 of the elongate elements 14 and the inside surfaces 34 of the elongate elements 16. If precisely a 15'×20' area is desired within the elongate elements 14, 16, the elongate elements 14 each must be 1½" longer than the 7½' length, previously described to make up for the distance over which they overlap.

Two of the elongate elements 14 are aligned end-to-end to produce a combined 15' length. A flat bracket 36, made of metal or plastic, can overlie the elongate elements 14 at the juncture 38 of the ends thereof. Fasteners 40, in the form of nails, screws, or the like, can be extended through the brackets 36 and into the elongate elements 14 to maintain the elongate elements 14 in end-to-end relationship. The elongate elements 16 are similarly aligned and connected through brackets 42 using fasteners 44. Modified brackets may be used with receptacles to maintain the elongate elements 14, 16 in a desired relationship without the need for separate fasteners.

L-shaped corner brackets 46 are used at the juncture between the ends of the elongate elements 14, 16, to define right angle corners 48, 50, 52, 54. The corner brackets 46 can be attached to each of the elongate elements 14, 16 at the corners 48, 50, 52, 54 using fasteners 56, of the type previously described.

By using elongate elements 14, 16 having a height of 10", the elongate elements 14, 16 can be conformed to irregular terrain while still permitting frozen surface of a sufficient thickness to be formed. By conforming the elongate elements 14, 16 to the terrain, the overall structure is stabilized without detracting from the quality of the frozen surface that is formed.

The flexible liner 18 is shaped and sized to fully cover the area within the surfaces 32, 34 of the elongate elements 14, 16, to extend upwardly therefrom to facially conform continuously to the inside surfaces 32, 34, the top edges 22, 24, and the outside surfaces 58, 60 of the elongate elements 14, 16.

The flexible liner 18 is folded to define preformed corners 62, 64, 66, 68 which nest within the corners 48, 50, 52, 54 on the border assembly 12. Each corner 62, 64, 66, 68 can be preformed in the same manner, as shown for exemplary corner 62 in FIGS. 5–9. All lines at which folding occurs on the liner 18 may be either pre-formed, as by a weakening, or formed on site.

Figure 7:
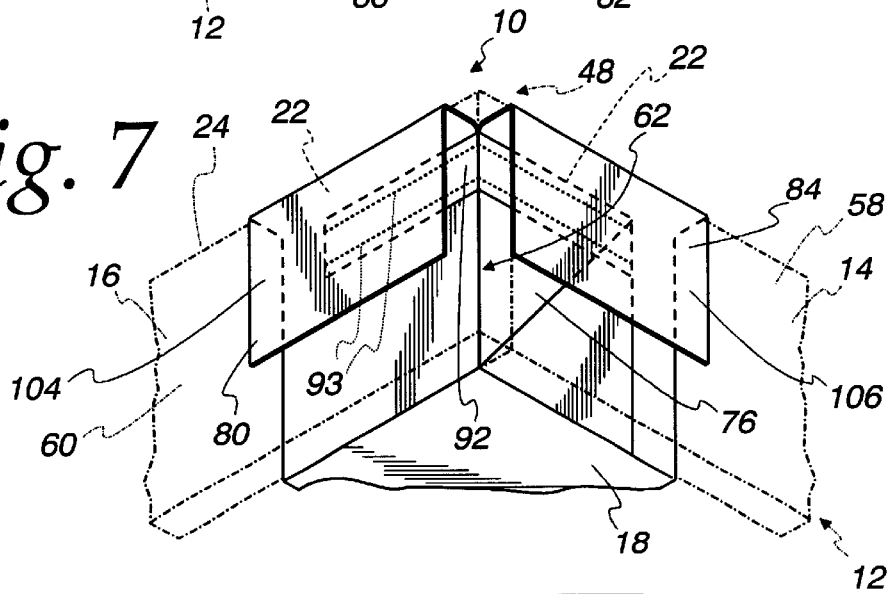
FIG. 7 is a view as in FIG. 6 from the outside of the corner.
Figure 8:
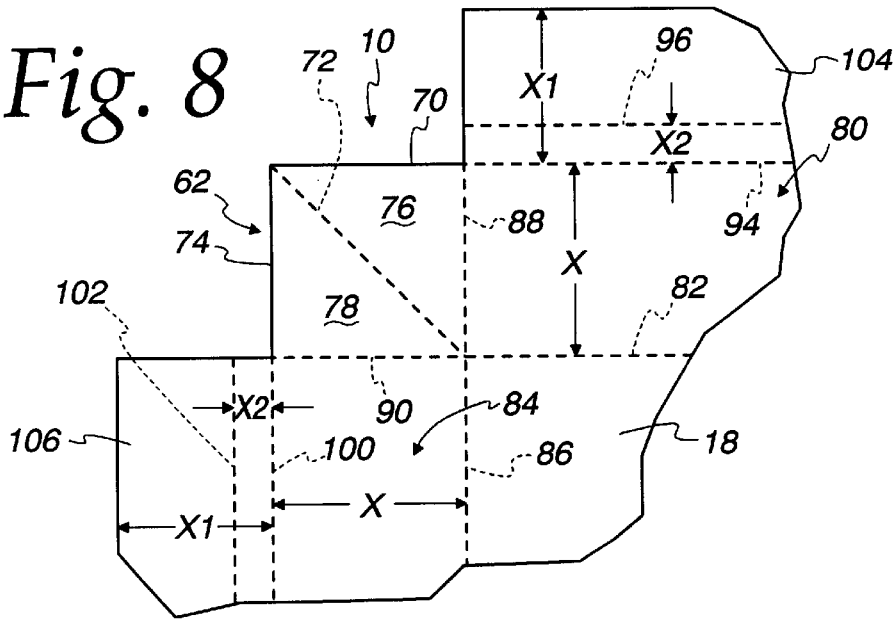
FIG. 8 is an enlarged, fragmentary, plan view of the flexible liner and showing the manner of reconfiguring the line in dotted to preform a corner therein.
Figure 9:
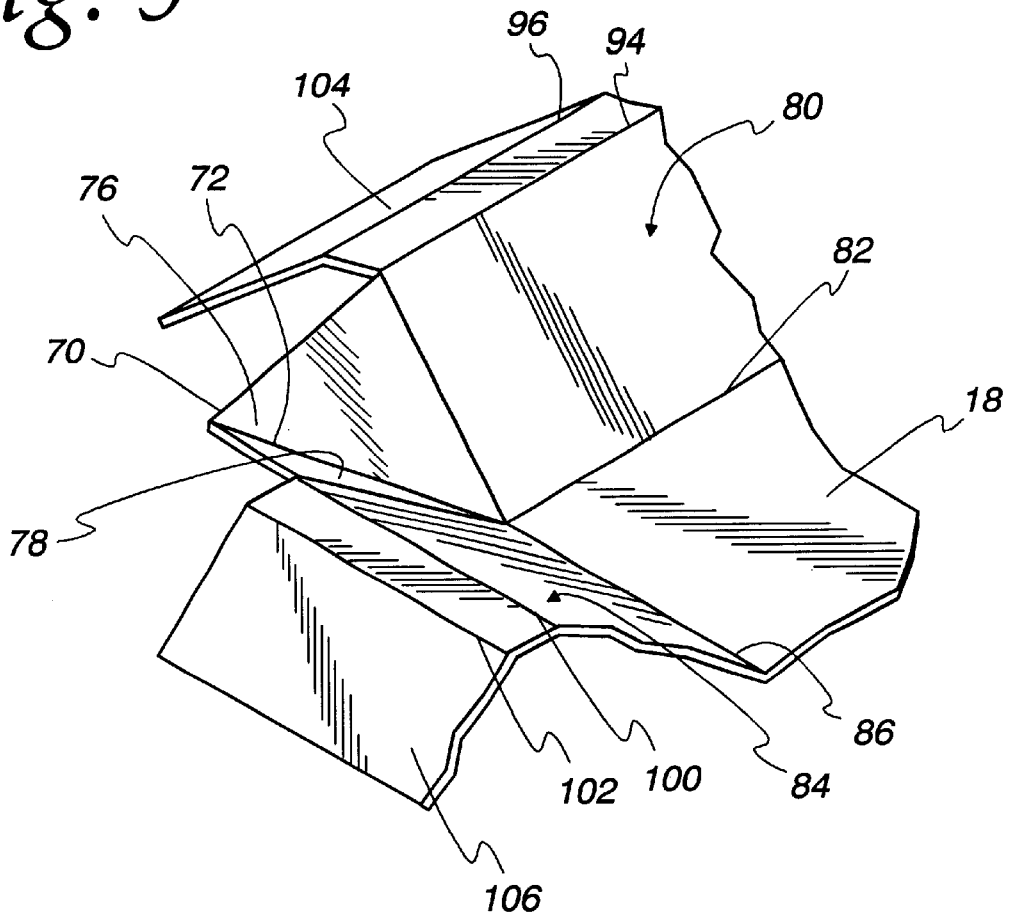
FIG. 9 is an enlarged, fragmentary, perspective view of the portion of the liner in FIG. 8 partially folded to form a comer.

More specifically, the flexible line 18 is cut out as shown and for use with elongate elements 14, 16 having a nominal 2"×10" dimension, the dimensions indicated thereon in FIG. 7 are as follows:

X=9½"

X1=8½"

To form the comer 62, an edge 70 is folded about a line 72 up to an edge 74, as shown in dotted lines, thereby forming two mutually overlying triangular flaps 76, 78. One rectangular flap 80, extending the length of the flexible liner 18, is folded about a line 82 to be perpendicular to the surface 30. A separate rectangular flap 84 is folded about the line 86 to be at right angles to the surface 30 and the flap 80. The flaps 76, 78 are then folded about lines 88, 90 to against the flap 84. To maintain the corner shape, the flap 78 can be adhesively bonded to the flap 84.

Alternatively, a reinforcement strip 92 can be sewn to each of the flaps 80, 84. Two lines of stitching 93 maintain the reinforcement strip 92 in place.

The flaps 80, 84 are facially conformed to the top edges 22, 24 by folding thereof around the lines 94, 96 and lines 100, 102. The lines 94, 96 and 100, 102 are spaced from each other by a dimension X2 that is equal to the thickness of the elongate elements 14, 16, in this case 1½".

An external flap portion 104, 106 depends one each from the flaps 80, 84 to facially abut to the outside surfaces 58, 60 of the elongate elements 14, 16.

The same folding pattern is used for the flexible liner 18 at each corner 48, 50, 52, 54 so that the flexible liner 18 defines an upwardly opening receptacle for a liquid to be frozen. The corners 62, 64, 66, 68 can be formed so that there is no opening in the flexible liner at the corner 62, 64, 66, 68 for several inches above the surface 30, as to thereby minimize the likelihood of leakage.

Figure 2:
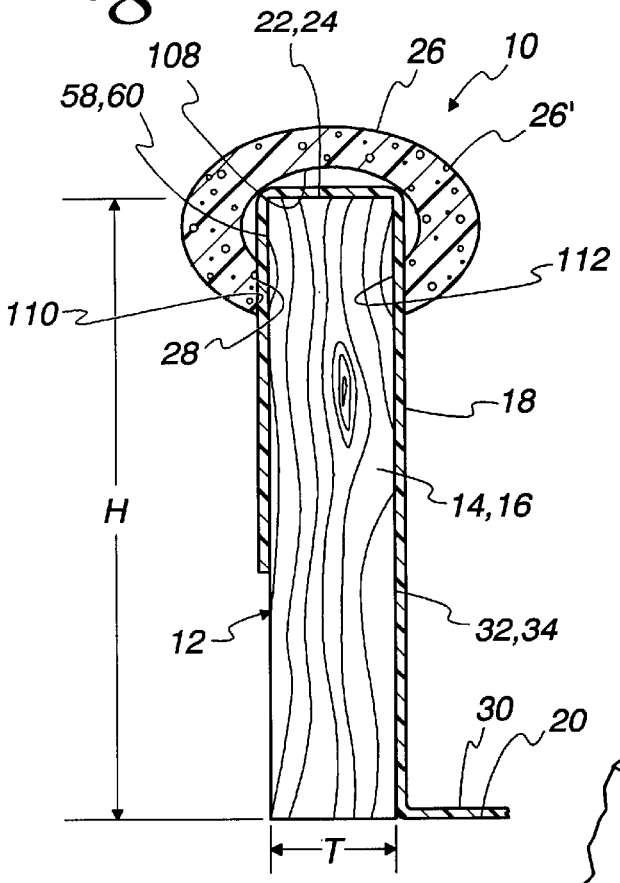
FIG. 2 is an enlarged, fragmentary, cross-sectional view of an elongate element forming the border assembly with the flexible liner attached thereto and a resilient bumper fit thereon to captively maintain the liner against the elongate element.
Figure 3:
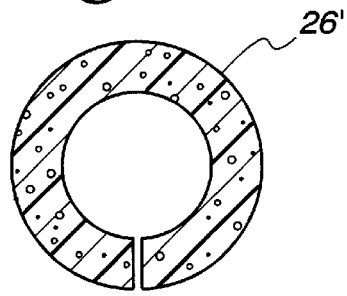
FIG. 3 is a cross-sectional view of an alternative form of resilient bumper, according to the present invention.
Figure 4:
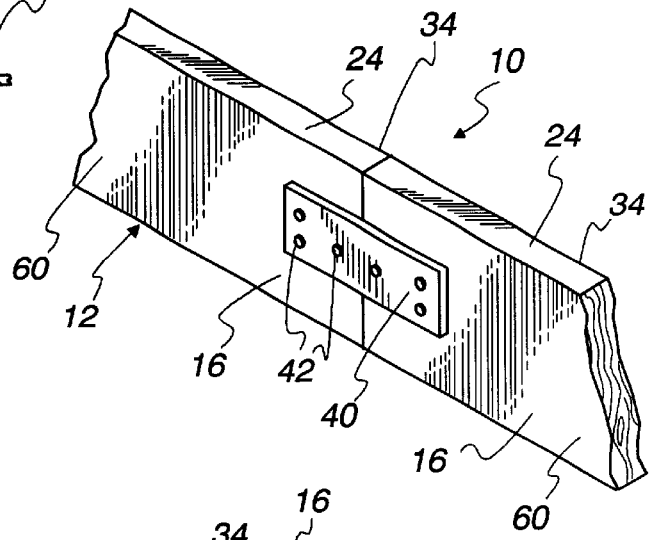
FIG. 4 is an enlarged, fragmentary, perspective view of two of the elongate elements held in end-to-end relationship by one form of bracket.
Figure 5:
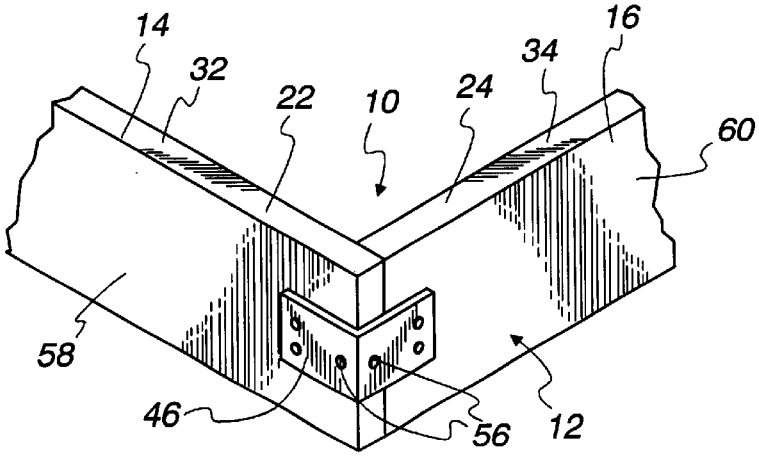
FIG. 5 is an enlarged, fragmentary, perspective view of two elongate elements held together by another form of bracket to form a corner.
Figure 6:
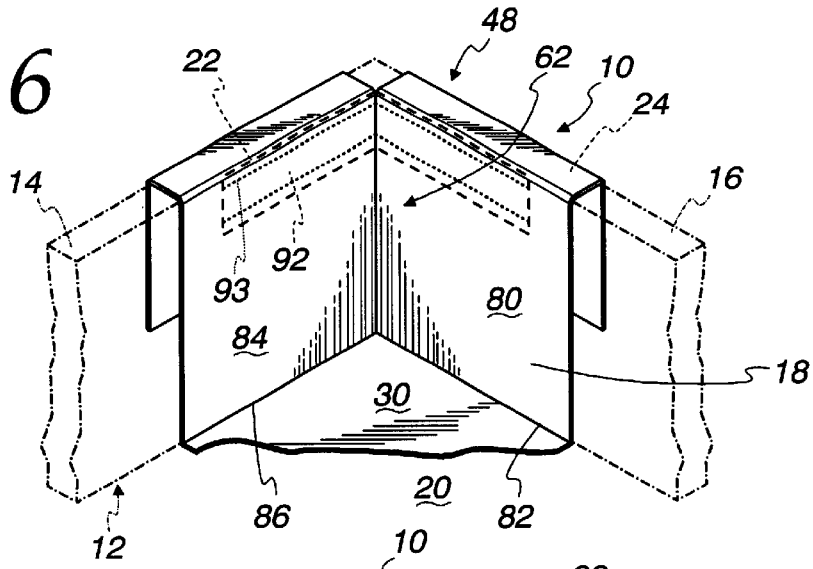
FIG. 6 is an enlarged, fragmentary, perspective view of the flexible liner operatively connected at a comer of the border assembly and shown from the inside of the corner.

Once the flexible liner 18 is nested within the border assembly 12, and folded up and around the elongate elements 14, 16, the resilient bumpers 26 can be installed. As seen in FIG. 2, each resilient bumper 26 has a C shape with a downwardly opening surface 108 which bears against the flexible liner 18 at the top edges 22, 24 of the elongate elements 14, 16. The resilient bumpers 26 are each preferably formed in a continuous oval shape, with one side cut to define facing surfaces 110, 112. By moving the surfaces 110, 112 away from each other a distance equal to the width of the elongate elements 14, 16, a restoring force is generated in the resilient bumpers 26. This restoring force causes the surfaces 110, 112 to grip the flexible elements 16, 18, with the flexible liner 18 disposed thereover and captively in between.

The resilient bumpers 26 can be made in any length but are preferably disposed edge-to-edge continuously around the elongate elements 14, 16 so that the user does not inadvertently contact the top edges 22, 24 of the elongate elements 14, 16 in use. The resilient bumpers 26 are preferably made from an industrial polymer with UV protection to prevent discoloration.

As shown in FIG. 2, similarly functioning resilient bumpers 26'can be made in a round cross-sectional shape rather than the oval shape, previously described.

Once the flexible liner 18 is in place, the receptacle defined thereby can be filled with water or other liquid that is to be frozen. The flexible liner 18 preferably does not have a UVI inhibitor. As a result, the flexible liner 18 can be installed over grass without being killed due to lack of exposure to the sun. One highly suitable construction for the flexible liner 18 is a white or clear fiber-reinforced material with the following specifications: 6 oz./yd$^2$; 1000 denier; 14×14 count; 12–12 mill thickness.

This material will conform readily to irregularities in the subjacent surface.

Figure 10:
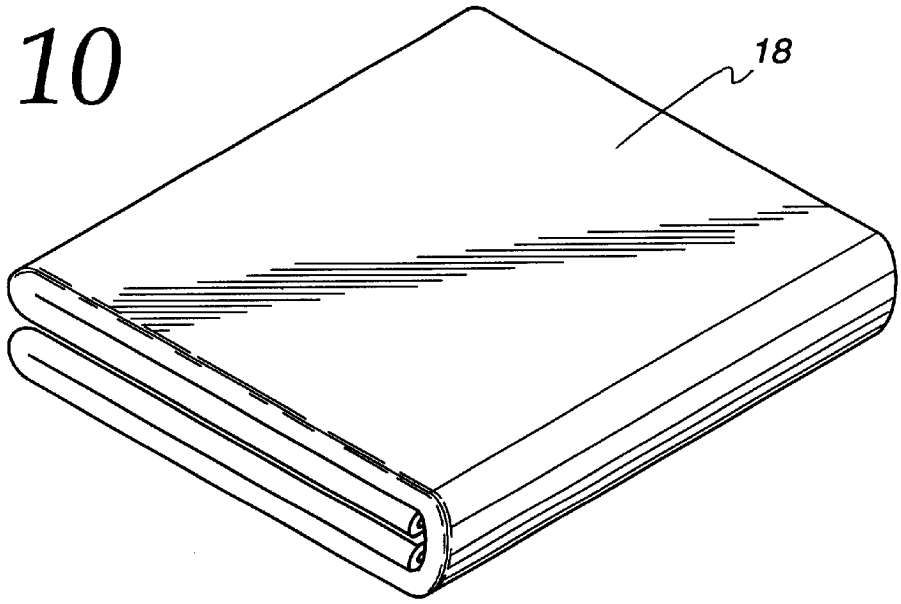
FIG. 10 is a perspective view of the flexible liner folded to a collapsed state.

The entire kit can be disassembled to a relatively compact state. In FIG. 10, the flexible liner 18 is shown repeatedly folded to a collapsed state. The compact arrangement of elements facilitates shipping and inventorying. Because the frame elements 14, 16 can be standard lumber items, the kit 10 can be conveniently offered by lumber yards, using existing stock.

The foregoing disclosure of specific embodiments is intended to be illustrative of the broad concepts comprehended by the invention.

What is claimed is:

1. A kit comprising:

a border assembly comprising a plurality of elongate elements that are capable of being placed against a subjacent surface to define a border around a predetermined area within which a frozen surface is to be formed, the elongate elements each having an inside surface, a top edge, and an outside surface and defining a corner at a juncture of two of the elongate elements; and a flexible liner that is selectively reconfigurable between a) a collapsed state, and b) an operative state, the flexible liner having a shape and size preselected to cover a subjacent surface in the predetermined area and to be placed against the elongate elements in a predetermined manner such that the flexible liner extends continuously from the subjacent surface to against the elongate elements and over the top edges of the elongate elements so as to define a receptacle for a liquid that can be cooled to form a frozen surface within the predetermined area, wherein the flexible liner has a corner preformed thereon, wherein the preformed comer on the flexible liner is nestable in the corner at the juncture of the two elongate elements.

2. The kit according to claim 1 wherein the elongate elements each have spaced ends and the elongate elements are alignable end-to-end to extend continuously around the predetermined area.

3. The kit according to claim 1 wherein the elongate elements are made from wood.

4. The kit according to claim 3 wherein the elongate elements have a nominal thickness on the order of 2 inches and a nominal width of from 4–12 inches.

5. The kit according to claim 1 wherein the corner of the flexible liner is preformed by adhering one part of the flexible liner to another part of the flexible liner.

6. The kit according to claim 1 further comprising a resilient bumper that has a receptacle for the top edge of one of the elongate elements with the resilient bumper fit to the one elongate element to prevent direct contact between a user and the top edge of the elongate elements to which the resilient bumper is fit.

7. The kit according to claim 1 wherein the flexible liner comprises non-UVI plastic.

8. The kit according to claim 1 wherein the flexible liner comprises fiber-reinforced plastic.

9. The kit according to claim 1 wherein the liner has four corners preformed therein such that adjacent sides of the liner form an edge that is perpendicular to the subjacent surface to nest at four inside corners defined by the elongate elements, with the predetermined area being one of square and rectangular in shape.

10. The kit according to claim 1 wherein with the flexible liner placed against the elongate elements in the predetermined manner, the liner defines a receptacle for liquid to be frozen that opens upwardly and extending upwardly from a subjacent surface at least 1 inch over the entire predetermined area.

11. The kit according to claim 1 wherein the liner has fold lines preformed thereon to facilitate folding in a predetermined manner against the elongate elements.

12. The kit according to claim 1 further comprising a bumper that can be press fit over the top edge of one of the elongate elements to captively hold the flexible liner against the one of the elongate elements.

13. The kit according to claim 2 including a plurality of brackets through which the ends of adjacent elongate elements can be joined, each to the other side.

14. A method of forming a frozen surface, said method comprising the steps of:

providing a plurality of elongate elements each having spaced ends, an inside surface, a top edge, and an outside surface;

placing the elongate elements end-to-end to define a border assembly around a predetermined area within which a frozen surface is to be formed;

providing a flexible liner;

placing the flexible liner on a subjacent surface within the predetermined area;

directing the flexible liner from the subjacent surface upwardly against the inside surfaces of the elongate elements;

extending the flexible liner over the top edges of the elongate elements and downwardly against the outside surfaces of the elongate elements;

providing at least one resilient bumper with a receptacle;

directing the at least one resilient bumper downwardly over the top edge of one of the elongate elements so that the top edge of the one of the elongate elements moves into the receptacle and the at least one resilient bumper prevents direct contact between a user and the top edge of the one of the elongate elements, the at least one elongate element having a length and the at least one resilient bumper extending over a substantial portion of the length of the at least one elongate element;

placing a liquid within the predetermined area over the liner; and freezing the liquid to define the frozen surface.

15. The method of forming a frozen surface according to claim 14 further comprising the steps of connecting the ends of adjacent elongate elements, each to the other, before directing the flexible liner against the inside surfaces of the elongate elements.

16. The method of forming a frozen surface according to claim 14 wherein the step of providing a flexible liner comprises the step of providing a flexible liner comprising a non-UVI material.

17. The method of forming a frozen surface according to claim 15 including the step of preforming a corner on the flexible liner by adhering one part of the flexible liner to another part of the flexible liner before placing the flexible liner on the subjacent surface.

18. The method of forming a frozen surface according to claim 14 wherein the step of providing a plurality of elongate members comprises providing a plurality of wooden elongate members having a nominal thickness on the order of 2 inches and a nominal width of from 4–12 inches.

19. A kit comprising:

a border assembly comprising a plurality of elongate elements that are capable of being placed against a subjacent surface to define a border around a predetermined area within which a frozen surface is to be formed, the elongate elements each having a bottom surface, an inside surface, a top edge, and an outside surface, the bottom surfaces being placeable against a flat subjacent surface so that the inside surfaces extend generally orthogonally to the flat subjacent surface and around the predetermined area;

a flexible liner that is selectively reconfigurable between a) a collapsed state, and b) an operative state, the flexible liner having a shape and size preselected to cover a subjacent surface in the predetermined area and to extend generally orthogonally to the flat subjacent surface against the inside surfaces of the elongate elements, over the top edges of the elongate elements, and downwardly against the outside surfaces of the elongate elements so as to define a receptacle for a liquid that can be cooled to form a frozen surface within the predetermined area; and at least one bumper that can be press fit over the top edge of one of the elongate elements over a substantially length of the one of the elongate elements.

20. The method of forming a frozen surface according to claim 14 wherein the step of constructing the flexible liner comprises the step of preforming a corner in the flexible liner and further comprising the step of nesting the preformed corner at a juncture between adjacent elongate elements so as to predictably and consistently interact the flexible liner with the border assembly.

21. The kit according to claim 1 further comprising at least one bumper that can be press fit over the top edge of one of the elongate elements over substantially the entire length of the one of the elongate elements.

22. The method of forming a frozen surface according to claim 14 wherein the at least one resilient bumper has a continuous cylindrical shape cut to define facing surfaces which grip the inside and outside surfaces of the one of the elongate elements.

23. The method of forming a frozen surface according to claim 14 wherein the top edges of the elongate elements have a length and the step of placing at least one resilient bumper comprises placing at least one resilient bumper over the majority of the length of the top edges of the elongate elements.

* * * * *